US007003817B1

(12) United States Patent
Pansini

(10) Patent No.: US 7,003,817 B1
(45) Date of Patent: Feb. 28, 2006

(54) TANK WITH AUTOMATIC FILL AND OVERFILL DRAIN

(76) Inventor: Andrew L. Pansini, 200 Golden Gate Ave., Belvedere, CA (US) 94920

( * ) Notice: Subject to any disclaimer, the term of this patent is extended or adjusted under 35 U.S.C. 154(b) by 0 days.

(21) Appl. No.: 10/079,014

(22) Filed: Feb. 19, 2002

(51) Int. Cl.
*E04H 4/12* (2006.01)

(52) U.S. Cl. ..... 4/508; 137/426; 137/428

(58) Field of Classification Search ..... 4/507, 4/508; 137/426, 428; 210/128, 169, 242.1
See application file for complete search history.

(56) References Cited

U.S. PATENT DOCUMENTS 3,386,107 A * 6/1968 Whitten, Jr. ..... 4/508
3,537,111 A * 11/1970 Whitten, Jr. ..... 4/508
3,739,405 A * 6/1973 Schmidt ..... 4/508
3,908,206 A * 9/1975 Grewing ..... 4/508
4,373,220 A * 2/1983 Selsted ..... 4/508
4,445,238 A * 5/1984 Maxhimer ..... 4/508
4,621,657 A 11/1986 St. Ledger
5,154,205 A * 10/1992 Langill ..... 4/508 X

* cited by examiner

*Primary Examiner*—Robert M. Fetsuga
(74) *Attorney, Agent, or Firm*—John K. Uilkema; Thelen Reid & Priest LLP

(57) ABSTRACT

A device for obtaining a desired pool water level is provided. The device includes a tank in communication with a pool containing a automatic fill device and an overfill drain device in fixed relation to each other. The height of the automatic fill device and overfill drain device can be simultaneously adjusted.

6 Claims, 4 Drawing Sheets

TANK WITH AUTOMATIC FILL AND OVERFILL DRAIN

BACKGROUND OF THE INVENTION

1. Field of the Invention

The present invention relates to an automatic fill water level control device and an overfill drain device for use with a swimming pool to obtain a desired pool water level. More specifically, the invention relates to a tank that is in communication with a pool and contains an adjustable automatic fill device and an overfill drain device in a fixed relationship to each other, so that setting the level of one of the devices automatically sets the level of the other device.

2. Related Art

Conventional pools contain overfill drains constructed as follows. A drain pipe is placed in the pool wall at the height of the desired water level. The drain pipe terminates either on the land surrounding the pool or into a nearby drain. Leaves and other debris floating on the pool water surface can plug the outlet hole in the pool wall, compromising the efficiency of the overfill drain.

U.S. Pat. No. 4,621,657 discloses a monitoring system for a swimming pool including a chamber in communication with the pool, adjustable fill means for determining a desired water level for the pool, and an overflow pipe for draining water from the chamber when the water level in the chamber exceeds the desired pool water level. The height of the overflow pipe is not fixed in relation to the automatic fill means. One must first set the automatic fill means then secondly adjust the overfill drain to be just slightly higher than the water level set by the automatic fill means.

Accordingly, it is desirable to provide a device containing an adjustable automatic fill device and an adjustable overfill drain device that are in fixed relation to each other and can be simultaneously adjusted to determine and adjust the desired water level in a pool.

SUMMARY OF THE INVENTION

The invention is directed to a device for adjusting the water level in a swimming pool including a tank that is in communication with the pool and contains an automatic fill device and an overfill drain device in fixed relation to each other. Providing the devices in a fixed relationship allows the height of both devices to be simultaneously adjusted to obtain a desired water level in the pool.

Other objects, features and advantages of the present invention will be apparent to those skilled in the art upon a reading of this specification including the accompanying drawings.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which.

DETAILED DESCRIPTION OF THE PREFERRED EMBODIMENTS

Figure 1:
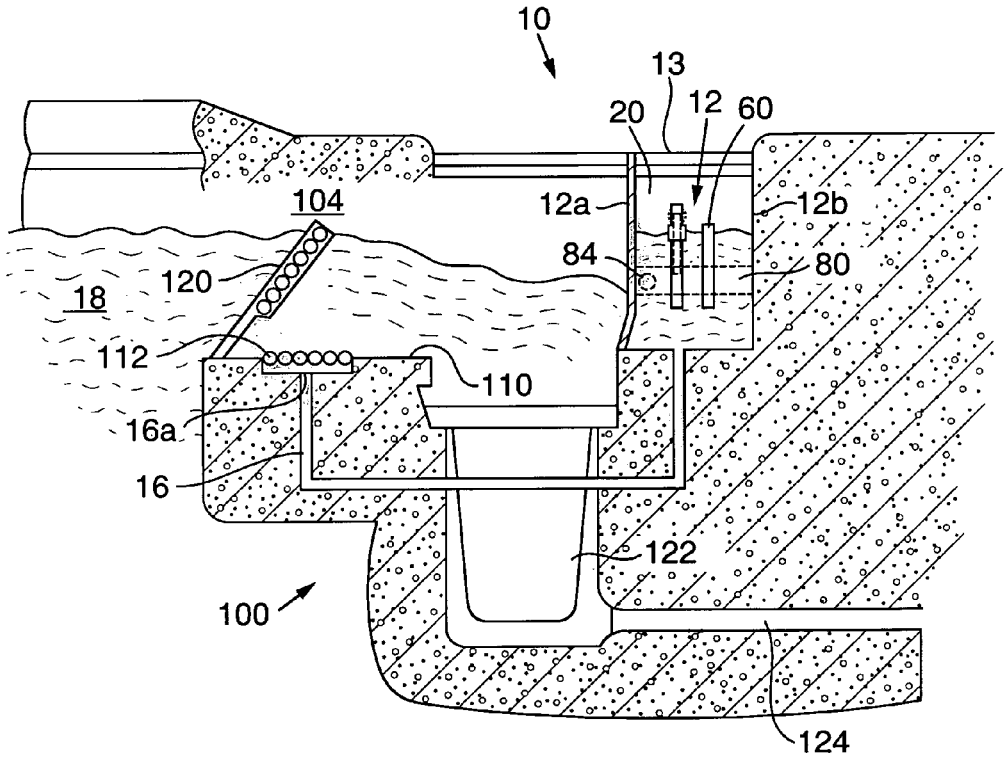
FIG. 1 is a cross-sectional elevational view of a conventional skimmer tank and the inventive device.

In describing preferred embodiments of the present invention illustrated in the drawings, specific terminology is employed for the sake of clarity. However, the invention is not intended to be limited to the specific terminology so selected, and it is to be understood that each specific element includes all technical equivalents that operate in a similar manner to accomplish a similar purpose.

The inventive device, designated device 10, includes a tank 12 that is in communication with a pool 18 via an equalizer line 16. Tank 12 is a relatively no flow chamber, and the water level in tank 12 is equal to the water level in pool 18. Tank 12 contains an automatic fill device 20 and an overfill drain device 60. Automatic fill device 20 allows water to enter the tank 12 and pool 18 when the water level of tank 12 and pool 18 reaches a preselected lower level. Overfill drain device 60 allows water to drain out of tank 12 and pool 16 when the water level of tank 12 and pool 16 reaches a level higher than that set by the automatic fill device. This would occur during a rainstorm. As described in detail below, automatic fill device 20 and overfill drain device 60 are in fixed relation to each other within tank 12, so that the height of both devices can be simultaneously adjusted to obtain a desired water level in the pool. Setting the height of one of the devices automatically sets the height of the other device.

As illustrated in FIG. 1, device 10 is preferably located adjacent to a conventional circular skimmer tank 100 which is in communication with pool 18 via passageway 104. A conventional skimmer weir 120 is hingedly connected to floor 110 of passageway 104 at the entrance to pool 18. Skimmer tank 100 also includes a skimmer basket 122 for retaining leaves and debris that are drawn into skimmer tank, and a drain pipe 124.

Equalizer line 16 connects tank 12 (a relatively no flow chamber) to passageway 104 of skimmer tank 100 (a positive pressure area) so that tank 12 is in communication with pool 18 and the water level in tank 12 is equal to that in pool 18. A filter screen 112 is preferably provided over the opening 16*a* of equalizer line 16 to prevent leaves and debris from clogging equalizer line 16 and from entering tank 12 and clogging overfill drain device 60. During operation, filter screen 112 is back flushed every time automatic fill device 20 is activated to allow water to enter tank 12.

Figure 2:
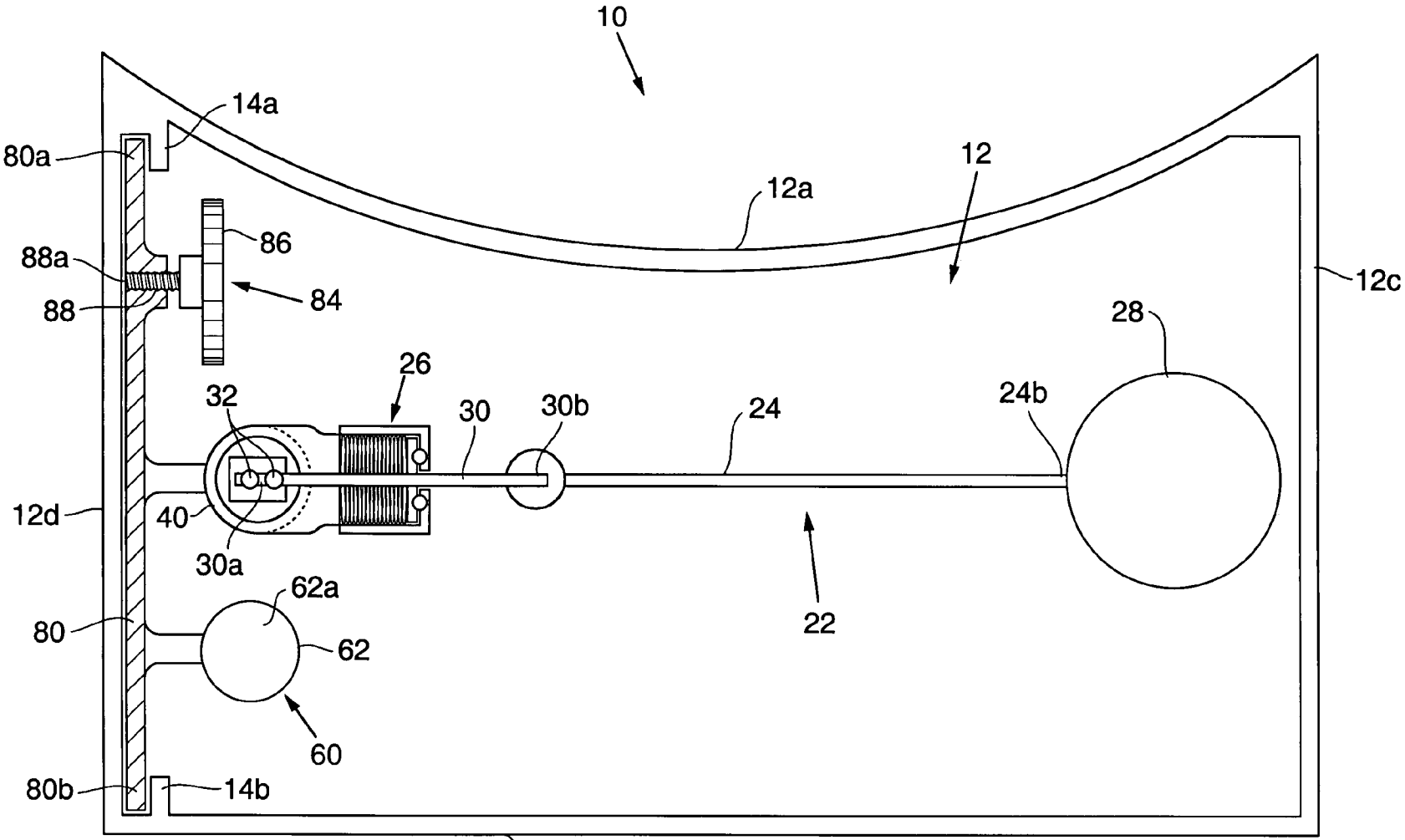
FIG. 2 is a top plan view of the inventive device.

As illustrated in FIG. 2, tank 12 has first, second, third and fourth sides 12*a*, 12*b*, 12*c*, 12*d*. Side 12*c* has wall connectors (not shown) for incoming and outgoing water. First side 12*a* is preferably concave, and configured so that first side 12*a* fits adjacent to the convex outer surface of circular skimmer tank 100. Locating device 10 adjacent skimmer tank 100 allows for easy access to device 10. Tank 12 may have a lid 13, or may be formed as part of skimmer tank 100 and share a common lid with skimmer tank 100.

Tank 12 contains automatic fill device 20 and overfill drain device 60 in a fixed relationship to each other. This can be accomplished by numerous designs in which automatic fill device 20 and overfill drain device 60 are connected to each other so that their height within tank 12 can be simultaneously adjusted.

By way of illustration and for exemplary purposes only, automatic fill device 20 and overfill drain device 60 can be mounted on a support member, in the form of an adjustable plate, 80 so that the height of automatic fill device 20 and overfill drain device 60 can be simultaneously adjusted via plate 80, as follows. First and second protrusions 14*a*, 14*b* extend vertically outwardly from first and second sides 12*a*, 12*b* of tank 12. First and second protrusions 14*a*, 14*b* slidably receive a portion of plate 80 and act as guide means for adjusting the height of plate 80, as follows. First and second ends 80*a*, 80*b* of plate 80 are slidably inserted between fourth side 12*d* of tank 12 and first and second protrusions 14*a*, 14*b*. The protrusions 14*a*, 14*b* provide channels which slidably receive the plate 80. The plate 80 provides means for mounting the automatic fill device 20 and overfill drain device 60 in fixed relationship to each other for unitary simultaneous elevational movement relative to the chamber provided by the tank 12. During such movement, the plate slides vertically within the channels defined by the protrusions 14*a*, 14*b*. Plate 80 is held in place against fourth side 12*d* of tank 12 by adjusting means 84. To adjust the desired pool level, the heights of automatic fill device 20 and overfill drain device 60 are simultaneously adjusted by backing off adjusting means 84, moving plate 80 to a desired position within tank 12 and engaging adjusting means 84 to lock and hold plate 80 in place in the desired position.

Figure 6:
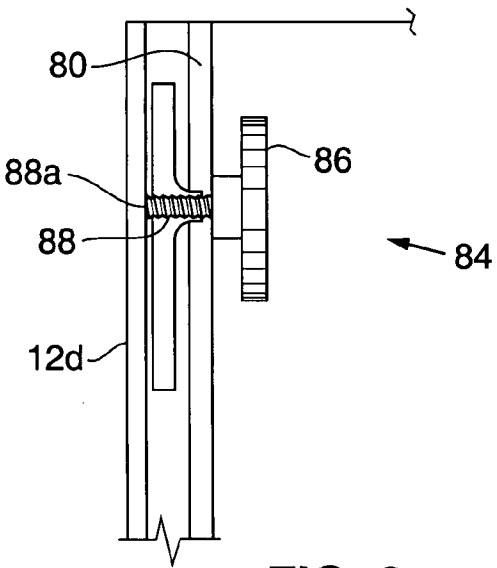
FIG. 6 is a side view of the adjusting means of the inventive device.

Adjusting means 84 may be a knob 86 attached to a screw 88 that extends through a threaded hole in plate 80, as illustrated in FIGS. 2 and 6. Plate 80 is held at a desired height in tank 12 by turning knob 86 in a first direction so that end 88*a* of screw 88 engages fourth side 12*d* of tank 12. To adjust the desired pool level, the height of automatic fill device 20 and overfill drain device 60 is simultaneously adjusted by turning knob 86 in a second direction to disengage end 88*a* of screw 88 from fourth side 12*d* of tank 12, sliding plate 80 vertically upward or downward to a desired pool water level, and turning knob 86 in the first direction to engage end 88*a* of screw 88 against fourth side 12*d* of tank 12.

Adjusting means 84 can be any other means suitable for adjusting the height of plate 80 and locking it in a desired position within tank 12. For example, one might utilize a threaded rod vertically attached to a common member of plate 80. The rod would have a knob on the top end, and by swivel means be held to the floor of the tank. Turning the knob in one direction raises the device, and turning the knob in the other direction lowers the device. Although the drawings show plate 80 in a vertical plane, it is to be understood that plate 80 could be guided in a horizontal plane, with mechanical means for raising, lowering and locking the device.

Figure 5:
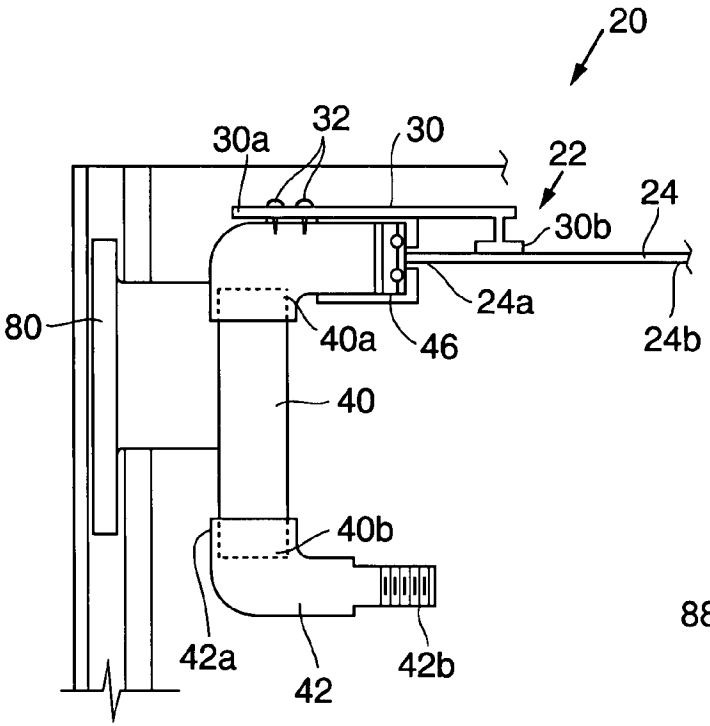
FIG. 5 is a side view of the automatic fill means of the inventive device.

Automatic fill device 20 allows water to enter tank 12 and pool 18 (via equalizer line 16) when the water level in tank 12 and pool 18 falls below a set level. As illustrated in FIGS. 2 and 5, automatic fill device 20 includes a float valve 22 having a float arm 24 with first and second ends 24*a*, 24*b*, a conventional valve 26 attached to first end 24*a* and a float ball 28 attached to second end 24*b*. Float ball 28 floats at the surface of the water in tank 12. A stop arm 30 is attached at its first end 30*a* to valve 26. Stop arm 30 may be attached to valve 26 by fasteners 32, such as screws, or any other suitable means. Second end 30*b* of stop arm 30 is engaged with float arm 24 when the water in tank 12 is at a higher level than desired, such as in a rain storm. Stopping the float arm 24 in the horizontal position prevents the valve 26 from adding still more water to the pool 18.

Valve 26 is connected to first end 40*a* of vertically oriented pipe 40. Second end 40*b* of vertically oriented pipe 40 is connected to first end 42*a* of elbow-shaped connector pipe 42. Second end 42*b* of connector pipe 42 is attached to a water source (not shown) that is external to tank 12.

Valve 26 is closed when second end 30*b* of stop arm 30 is engaged with float arm 24. When the water level in tank 12 drops and falls below the preselected level, float arm 24 rocks the seal of valve 26, thereby breaking the seal, opening valve 26 and allowing water from the external water source (not shown) to move through connector pipe 42, up through vertically oriented pipe 40 and out valve 26 into tank 12.

During heavy rain conditions when the water level in tank 12 and pool 18 rises above the preselected water level, stop arm 30 prevents float arm 24 from rising with the water above the preselected level, thereby preventing float arm 24 from opening float valve 26 and allowing water to enter tank 12. This prevents automatic fill device 20 from counteracting the drainage action of overfill drain device 60 during heavy rain conditions.

Figure 3:
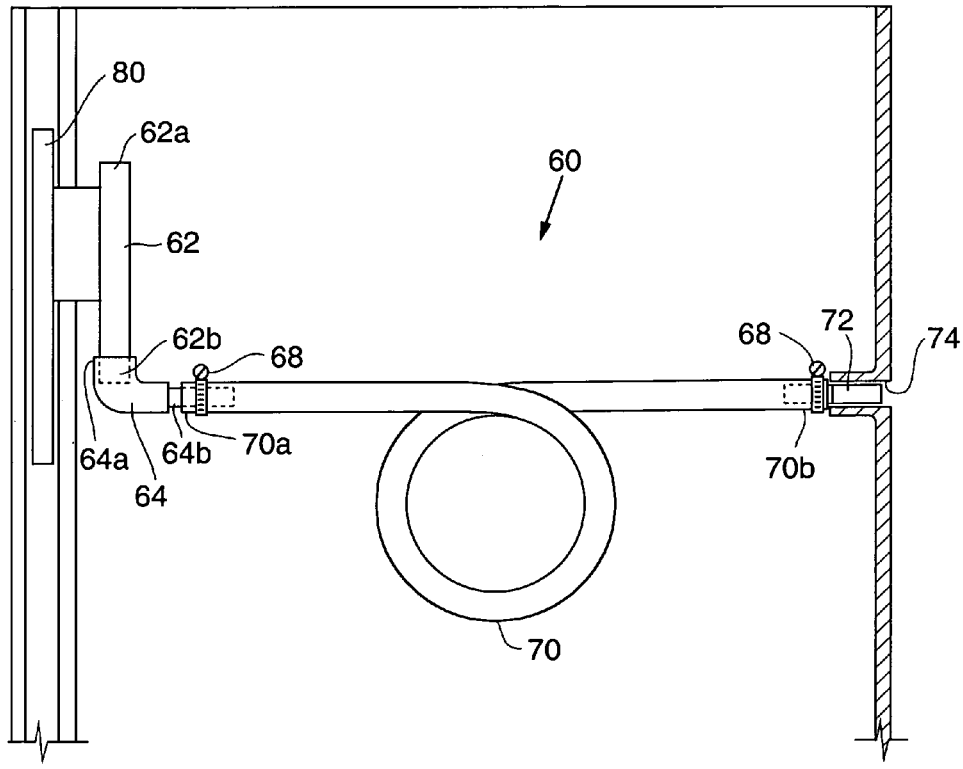
FIG. 3 is a side view of the overflow means of the inventive device.
Figure 4:
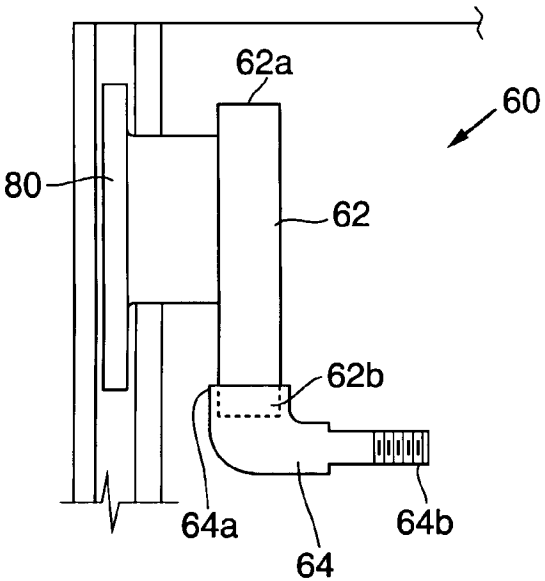
FIG. 4 is a side view of the overflow means of the inventive device.

Overfill drain device 60 allows excess water to drain out of tank 12 and pool 18 when the water level is higher than the preselected water level set by adjusting the height of automatic fill device 20 and overfill drain device 60 in tank 12 via plate 80. As illustrated in FIGS. 3 and 4, overfill drain device 60 includes a vertically oriented hollow pipe attached to adjustable plate 80. First end 62*a* of pipe 62 is open, forming an inlet. Second end 62*b* of pipe 62 is attached to first end 64*a* of elbow pipe connector 64. Second end 64*b* of elbow pipe connector 64 is attached to first end 70*a* of hose 70. Second end 70*b* of hose 70 is connected to overfill drain pipe 72 which passes through outlet 74 formed in tank 12. Clamps 68 may be used to securely connect first end 70*a* of hose 70 to second end 64*b* of elbow connection pipe 64 and second end 70*b* of hose 70 to overfill drain pipe 72. Hose 70 may be looped, as illustrated in FIG. 3, so that it can flex with the movement of plate 80 if a new water level is selected.

The desired water level is selected by the following method: providing a tank 12 that is in communication with pool 18 and that contains automatic fill device 20 and overfill drain device 60 in fixed relation to each other, wherein elevational movement of the automatic fill device 20 and overfill drain device 60 relative to tank 12 is not restricted by any attachment to tank 12, the heights of the automatic fill device 20 and overfill drain device 60 within the tank are adjustable and setting the height of one of the devices in the tank automatically sets the height of the other device in the tank and simultaneously adjusting the height of automatic fill device 20 and overfill drain device 60 within tank 12 via plate 80 so that the valve 26 will be at the desired water level. Float ball 28 is preferably weighted so that it rides half out of the water and half under water. This keeps the float arm 24 in a horizontal position on the surface of the water when the valve 26 is closed. When the water level in tank 12 rises above the preselected water level, such as during a rain storm, the excess water drains out of tank 12 and pool 18 through the first end 62*a*, pipe 62, elbow pipe connector 64, hose 70, overfill drain pipe 72 and out outlet 74 to the surrounding ground or a drain located outside of tank 12.

Locating outlet 74 for overfill drain device 60 outside of pool 18 avoids the problem of leaves and debris from the pool clogging the outlet, and eliminates the necessity of providing a separate pipe through the pool wall for overfill drain device 60. It is to be understood that automatic fill device 20 is connected to an outside water source by a hose as shown in FIG. 3 for the overfill drain.

Modifications and variations of the above-described embodiments of the present invention are possible, as appreciated by those skilled in the art in light of the above teachings. For example, tank 12 may be formed as part of skimmer tank 100, automatic fill device 20 and overfill drain device 60 can be connected in fixed relation to each other by any conventional means, and adjusting means 84 can be suitable means for adjusting the height of automatic fill device 20 and overfill drain device 60. It is therefore to be understood that, within the scope of the appended claims and their equivalents, the invention may be practiced otherwise than as specifically described.

What is claimed is:

1. A tank in communication with a swimming pool, said tank containing both an automatic fill device and an overfill drain device secured to a common support member for unitary elevational adjustment relative to the tank to enable the heights of the automatic fill device and overfill drain device within the tank to be simultaneously and unitarily adjusted to set a desired pool water level, and further comprising adjusting means for adjusting the height of the automatic fill device and the overfill drain device within the tank.

2. A tank in communication with a swimming pool, said tank containing an automatic fill device and an overfill drain device connected to each other in a fixed relationship for simultaneous elevational adjustment relative to the tank, whereby setting the elevation of one of the devices automatically sets the elevation of the other of the devices, wherein the automatic fill device and the overfill drain device are connected to a vertically adjustable member, and further comprising adjusting means to selectively secure the vertically adjustable member at different levels within the tank.

3. The tank of claim 2, wherein when the height of the vertically adjustable member is set a preselected water level is set, the overfill drain device has an inlet, and the inlet is located above the preselected water level.

4. A skimmer comprising:

a positive pressure area;

a relatively no flow chamber in communication with the positive pressure area of the skimmer;

an automatic fill device contained in the chamber; and an overfill drain device contained within the chamber;

means for connecting the automatic fill device and overfill drain device in a fixed relationship to each other for simultaneous elevational movement relative to the chamber, whereby the heights of the automatic fill device and overfill drain device within the tank are simultaneously adjustable, and setting the height of one of the devices in the chamber automatically sets the height of the other device in the chamber, and wherein the automatic fill device and the overfill drain device are attached to an adjustable plate.

5. The skimmer of claim 4, further comprising adjusting means for adjusting the height of the plate within the chamber.

6. A skimmer comprising:

a positive pressure area;

a relatively no flow chamber in communication with the positive pressure area of the skimmer;

an automatic fill device contained in the chamber;

wherein the automatic fill device and overfill drain device are attached to an adjustable plate; and adjusting means for adjusting the height of the plate within the tank.

* * * * *